US007350336B2

(12) United States Patent
Bennett

(10) Patent No.: US 7,350,336 B2
(45) Date of Patent: Apr. 1, 2008

(54) CONTINUOUS THRESHOLD ASSEMBLY WITH MODULAR INTERLOCKING SUBSTRATE SECTIONS

(75) Inventor: Joel S. Bennett, Greensboro, NC (US)

(73) Assignee: Endura Products, Inc., Colfax, NC (US)

( * ) Notice: Subject to any disclaimer, the term of this patent is extended or adjusted under 35 U.S.C. 154(b) by 0 days.

(21) Appl. No.: 10/156,391

(22) Filed: May 28, 2002

(65) Prior Publication Data

US 2002/0194788 A1 Dec. 26, 2002

Related U.S. Application Data

(60) Provisional application No. 60/294,150, filed on May 29, 2001.

(51) Int. Cl.
*B65B 1/04* (2006.01)

(52) U.S. Cl. ..... 49/467

(58) Field of Classification Search ..... None
See application file for complete search history.

(56) References Cited

U.S. PATENT DOCUMENTS 1,914,830 A * 6/1933 Kostohris ..... 104/275
2,089,380 A * 8/1937 Kammerer ..... 49/468
5,095,822 A * 3/1992 Martin ..... 104/275
5,673,517 A * 10/1997 Stanclift ..... 49/468
5,777,266 A * 7/1998 Herman et al. ..... 174/68.1
D415,471 S * 10/1999 Henry
D418,818 S * 1/2000 Henry

* cited by examiner

*Primary Examiner*—Jerry Redman
(74) *Attorney, Agent, or Firm*—Jack B. Hicks; Womble Carlyle Sandridge & Rice, PLLC

(57) ABSTRACT

A threshold system includes modular plastic substrate sections of predetermined lengths that are attachable together end-to-end in a number of configurations to form substrates of various total lengths. A threshold assembly of a desired length is assembled by attaching selected substrate sections together to form a support substrate having a length corresponding to the sums of the lengths of the substrate sections, mounting an extruded aluminum sill to the support substrate, and mounting a threshold cap in the upwardly open channel formed by the attached substrate sections and the sill. A nosing strip may be secured along the inside of the finished threshold to cover the intersections between joined substrate sections and to provide an aesthetically pleasing appearance from the inside of a building in which the threshold is installed.

10 Claims, 5 Drawing Sheets

CONTINUOUS THRESHOLD ASSEMBLY WITH MODULAR INTERLOCKING SUBSTRATE SECTIONS

PRIORITY CLAIM

Priority is hereby claimed to the filing date of provisional patent application Ser. No. 60/294,150 filed on May 29, 2001.

TECHNICAL FIELD

This invention relates generally to entryway systems for homes and commercial buildings and more specifically to entryway systems incorporating continuous threshold assemblies that extend beneath one or more doors and/or the doors and one or more sidelight panels of the entryway. The disclosure of pending U.S. patent application Ser. No. 10/004,613 filed Nov. 1, 2001 (hereinafter the "incorporated disclosure") is hereby incorporated in its entirety as if fully set forth herein.

BACKGROUND

Continuous threshold assemblies have become common in residential and commercial construction. Such assemblies generally include a support substrate covered by an extruded aluminum sill. The substrate and sill form an upwardly open channel positioned to underlie a closed door and an adjustable threshold cap is disposed in the channel. For entryways with sidelights, the threshold assembly extends continuously beneath both the door, the sidelights, and the mull posts that separate the door opening from the sidelight openings and a panel cap is positioned in the channel underlying the sidelight panel.

As discussed in some detail in the incorporated disclosure, the integration of an injection molded plastic support substrate, which may or may not included integrally molded jamb boots, into a continuous threshold assembly addresses certain needs in the building industry. For instance, such a substrate is dimensionally stable, provides superior support for the aluminum sill of the assembly, is resistant to rot and deterioration, and may be configured to define, at least in part, the upwardly open channel of the assembly within which a threshold cap resides, thus eliminating parts and assembly steps.

A potential shortcoming of a molded plastic substrate in a threshold assembly is that a given substrate is inherently fixed in length because it is formed in a fixed injection mold. Unfortunately, entryways beneath which continuous threshold assemblies are installed have a wide variety of widths depending, for example, on the width of the door of the entryway, the number of doors, and whether or not the entryway includes one or more sidelight panels that flank the door(s) of the entryway. It will thus be seen that incorporation of fixed length molded plastic substrates in continuous threshold assemblies requires that multiple substrates of various lengths be fabricated, inventoried, stocked, and managed by threshold manufacturers and/or pre-hangers in order to provide a substrate of appropriate length for the threshold of each possible entryway configuration. Furthermore, expensive injection molds must be produced and maintained to provide a reliable supply of the many possible lengths of substrates.

A need exists for a continuous threshold assembly incorporating a molded plastic substrate that does not require the fabrication and stocking of substrates in a large number of lengths. A further need exists for a threshold system that is selectively adaptable and configurable to fit a large variety of entryway designs with a minimum of components to be stocked and maintained. It is to the provision of such a continuous threshold assembly and a fabrication method using same that the present invention is primarily directed.

SUMMARY OF THE INVENTION

Briefly described, the present invention, in one preferred embodiment thereof, comprises a unique threshold assembly having a support substrate formed from two or more substrate sections joined together in end-to-end relationship. The substrate sections preferably are molded of plastic or a plastic composite material that is resistant to deterioration and rot and that is thermally and dimensionally stable. An extruded aluminum sill is snapped into place over the substrate and the sill and substrate form an elongated upwardly open channel along the back side of the threshold assembly. An adjustable threshold cap may be positioned in the channel and, for entryways with sidelights, sidelight caps also may be placed in the channel to underlie and support the sidelight panels. A nosing strip is snapped into place covering the inside nosing of the substrate sections to provide a pleasing appearance and to cover the junction between the two joined together substrate sections.

The substrate sections may be joined together in a variety of ways including, for example, with dovetail tongues and slots, sliding dovetail joints, or any other appropriate mechanism, which preferably is molded into the substrate sections. The forming of the substrate by the joining together of substrate sections offers distinct advantages over fixed length support substrates. More specifically, the use of just a few judicially sized standard substrate sections, joinable in a variety of configurations, can accommodate a wide variety of entryway sizes and configurations. For example, a door-length substrate section may be formed with a length corresponding to the width of a common entry door. Similarly, a sidelight-length substrate section may be formed with a length corresponding to the width of a standard sidelight panel. Joining together just these two substrate sections in a variety of ways can form the support substrates of a wide variety of sizes. For instance, a single door entryway can be accommodated using just the door-length substrate section while a double door entryway is accommodated by joining together two of the door-length substrate sections. An entryway with a door and one sidelight is accommodated by joining a sidelight-length substrate section to one end of a door-length section and a double sidelight entryway is accommodated by joining a sidelight-length threshold section to each end of a door-length substrate section, and so it goes.

Accordingly, a threshold assembly and method of assembly is now provided that successfully addresses many problems and shortcomings of the prior art. The fabrication and stocking of just two or three standard substrate sections is all that is required for the production of threshold assemblies in virtually any desired length. The assembly of such threshold assemblies is exceedingly efficient. The proper substrate sections are simply selected and joined together to form a substrate of appropriate length, whereupon a cut-to-length aluminum sill is snapped into place covering and reinforcing the substrate. A threshold cap and, where applicable, panel caps are placed in the upwardly open channel formed by the sill and substrate and a nosing cap is snapped into place covering the inside nosing of the assembly. The completed threshold assembly is then ready to be incorporated into an entryway by being joined at its ends to the bottoms of the vertical jambs of the entryway in the standard way.

It will thus be seen that the unique threshold assembly and method of the present invention eliminates the problems with fixed length substrates, provides an extremely versatile way of manufacturing threshold assemblies for a wide variety of entryways with a few standard components, and simplifies the threshold assembly and fabrication process considerably. These and other features and advantages of this invention will become more apparent upon review of the detailed description set forth below taken in conjunction with the accompanying drawing figures, which are briefly described as follows.

DETAILED DESCRIPTION OF THE PREFERRED EMBODIMENTS

Figure 1:
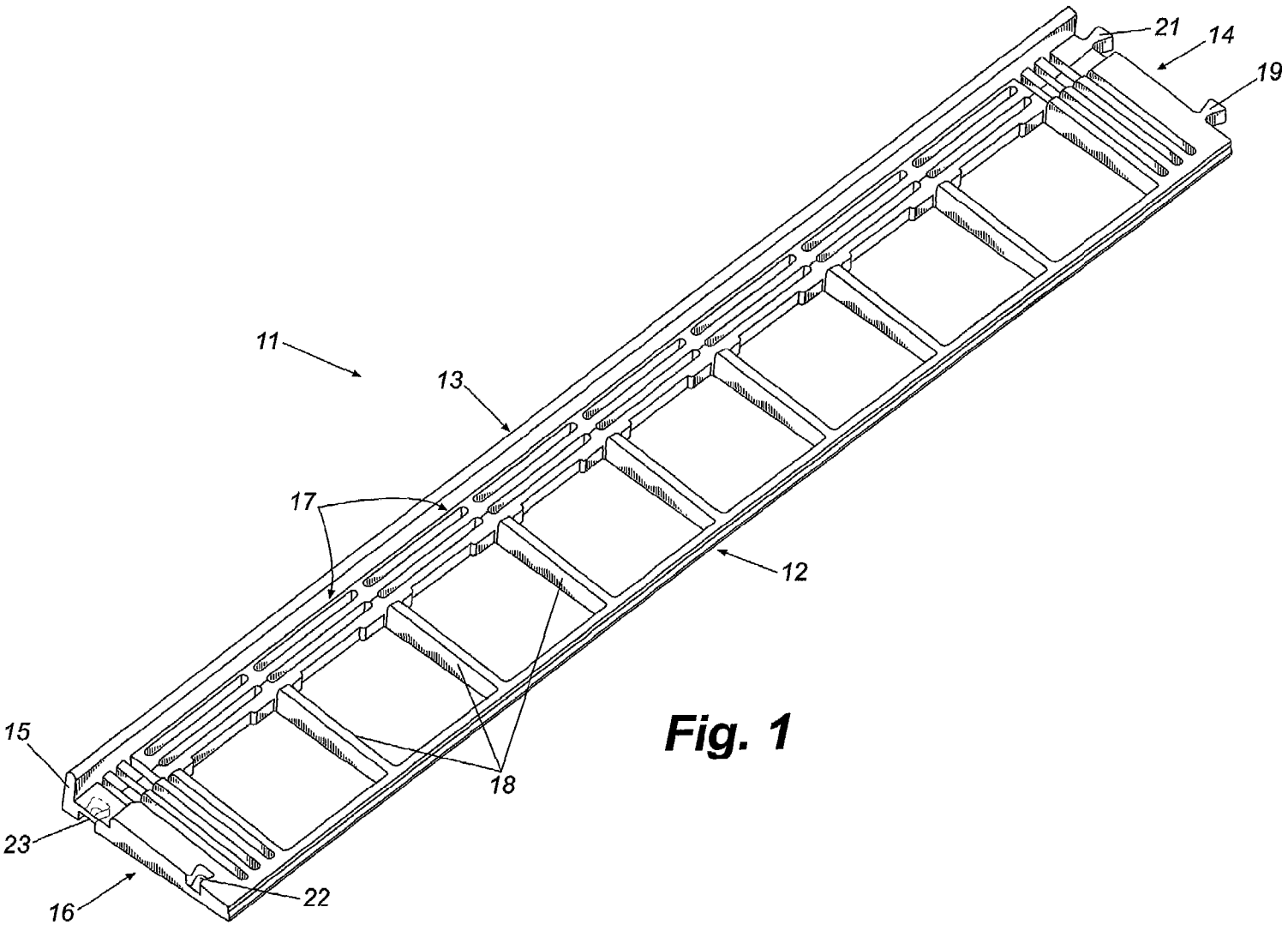
FIG. 1 is a perspective view of a molded plastic substrate section for a continuous threshold assembly that embodies principles of the invention in a preferred form.
Figure 5:
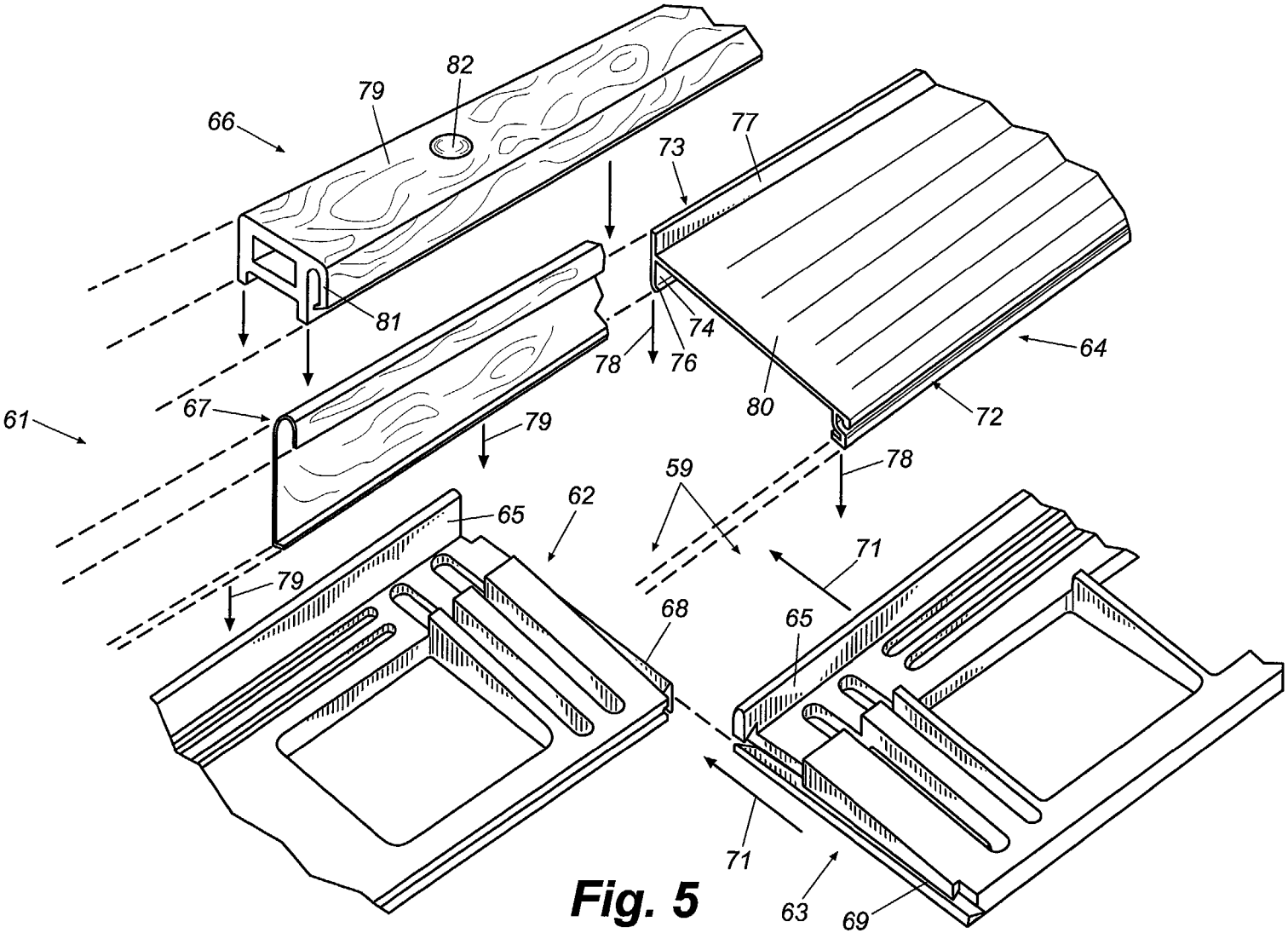
FIG. 5 is a perspective exploded illustration showing a preferred method of fabricating a continuous threshold assembly using the modular substrate sections according to the invention.

Referring now in more detail to the drawings, in which like numerals refer to like parts throughout the several views, FIG. 1 shows a molded plastic substrate section for installation in a threshold assembly according to the invention. The elongated plastic substrate section 11 is formed with a front or outside edge portion 12, a back or inside edge portion 13, a first end portion 14, and a second end portion 16. An upwardly open channel 17 is defined adjacent and along the back edge portion of the substrate section for receiving and holding an adjustable threshold cap of a threshold assembly incorporating the substrate, as detailed below. The upwardly open channel 17 is bounded along the back edge portion 13 of the substrate section by an upstanding nosing 15. An array of spaced apart support ribs 18 extend from the forward edge of the channel 17 to the front edge portion 12 of the substrate section. Although not illustrated in FIG. 1, it will be understood, as shown in FIG. 5, that in the completed assembly, an extruded aluminum sill normally snaps or is otherwise secured in place on the substrate section covering and being supported by the support ribs 18 thereof. In a preferred embodiment, the aluminum sill has an outside edge portion that fits over the front edge portion 12 of the substrate section, an inside edge portion formed with a depending tongue that snaps over the backs of the ribs 18, and an upstanding dam that forms the front wall of the upwardly open channel 17 when the sill is snapped into place.

Figure 4:
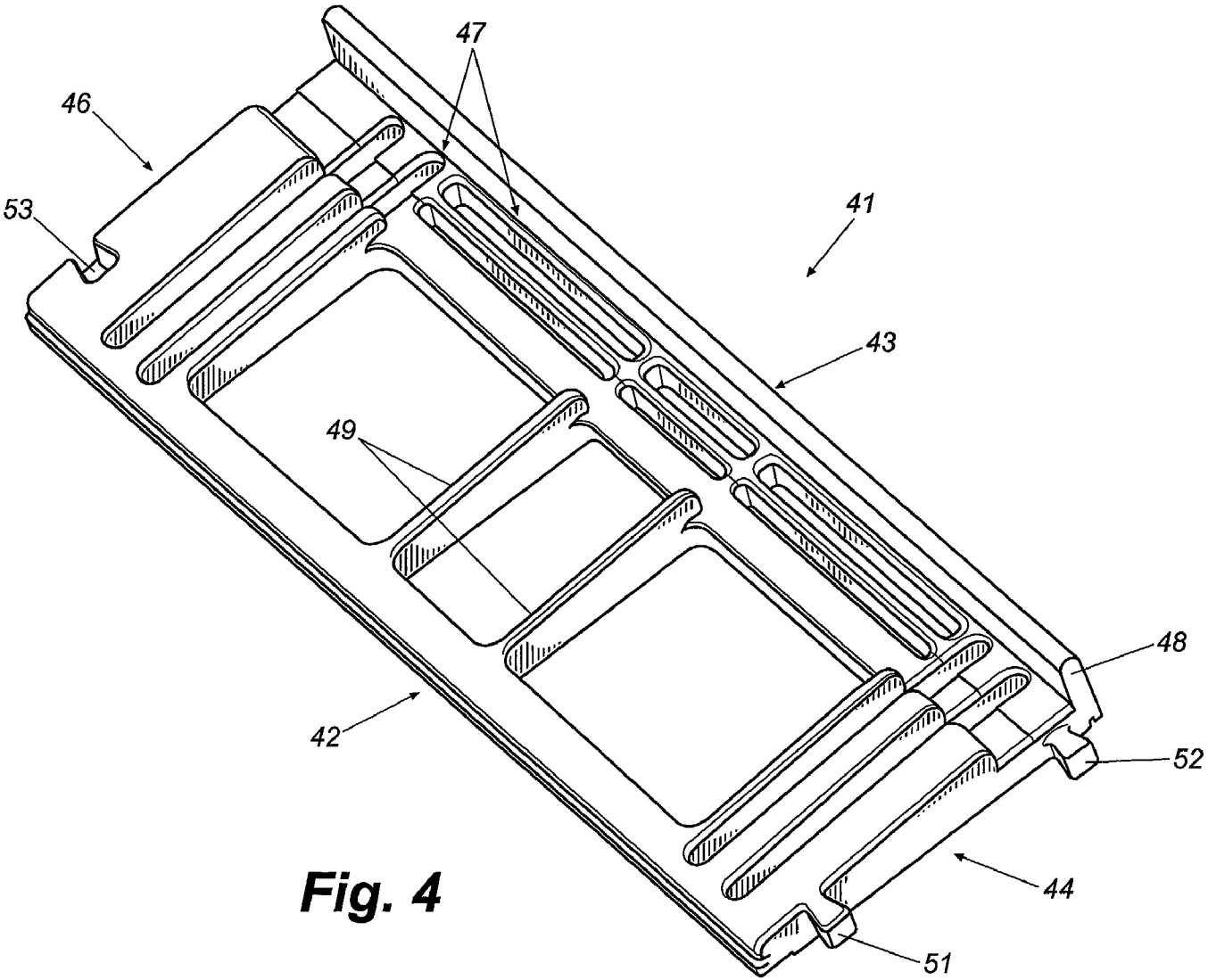
FIG. 4 is a perspective view of a shorter substrate section according to one embodiment of the invention.

A pair of dovetail tongues 19 and 21 are formed on and project from the end portion 14 of the substrate section 11. A matching pair of dovetail slots 22 and 23 are formed in the opposite end portion 16 of the substrate section. The slots 22 and 23 are sized and positioned to receive and mate with a pair of dovetail tongues 19 and 21 on the end 14 of a similar substrate section so that the two sections may be joined together in end-to-end relationship. More specifically, the forward dovetail slot 22 on end portion 16 is seen to be formed in the top or upper surface of the end portion while the rear dovetail slot 23 is formed in the bottom or lower surface of the end portion. Similarly, as best illustrated in FIG. 4, the forward dovetail tongue on end portion 14 is formed adjacent the upper surface of the end portion while the rear dovetail tongue is formed adjacent the lower surface thereof. With this configuration, it will be seen that two similar substrate sections may be attached end-to-end by placing their mating end portions together and twisting one substrate section with respect to the other. In this way, the forward dovetail tongue is forced into and locks in place within the forward dovetail groove from the top while the rear dovetail tongue is forced into and locks in place within the rear dovetail grove from the bottom. The two substrate sections are thus locked together to form a continuously extending substrate having a length corresponding to the sum of the lengths of the two substrate sections. The aluminum sill, when snapped into place covering the joined sections, further reinforces the joined sections to form a rigid monolithic threshold assembly.

Figure 2:
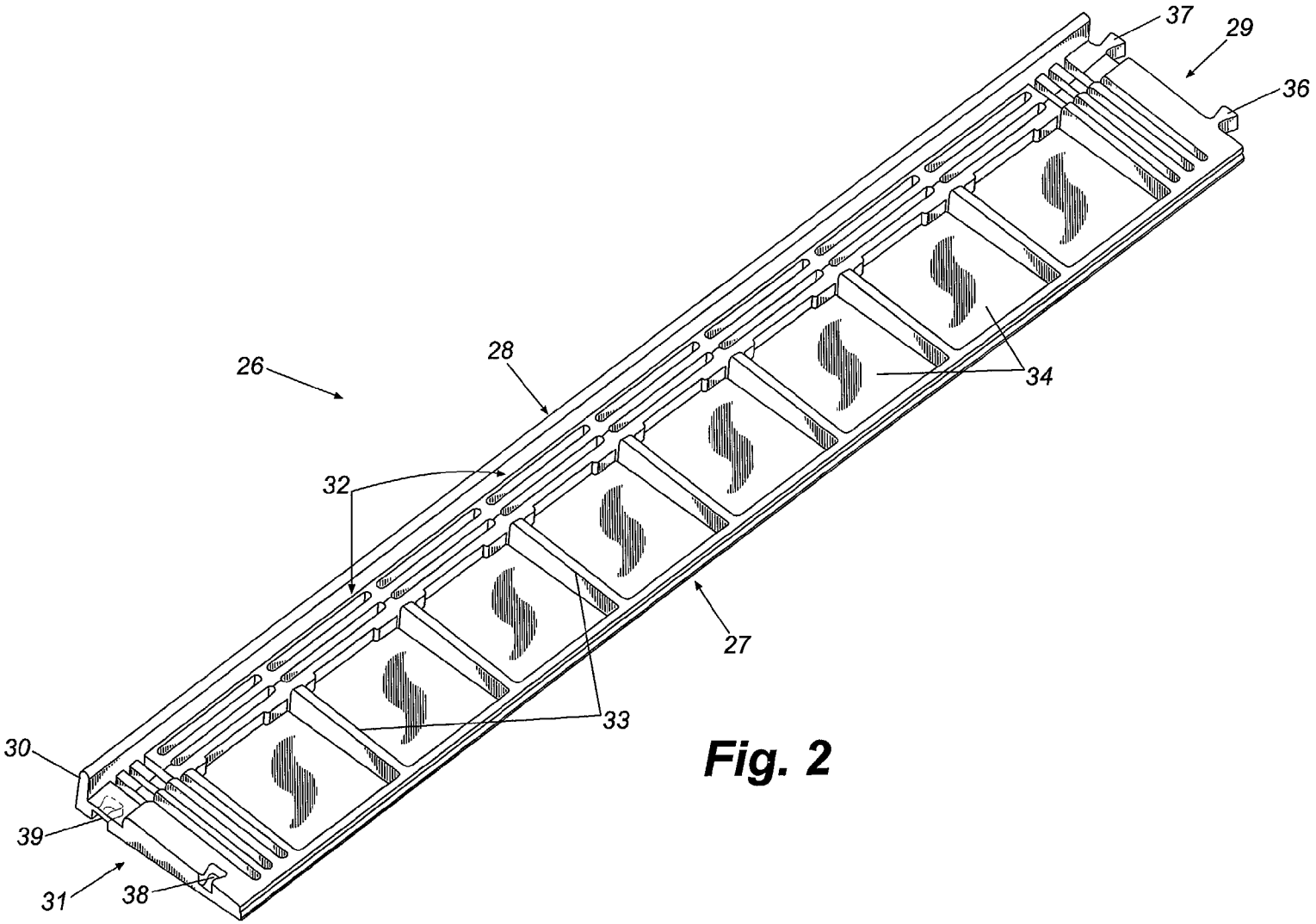
FIG. 2 is a perspective view of a molded plastic substrate section for a continuous threshold assembly that embodies principles of the invention in an alternate preferred form.

FIG. 2 illustrates a molded plastic substrate section that is similar in many respects to the substrate section of FIG. 1 but that has a closed or full version design wherein the support ribs of the substrate section are spanned by webs. The webs strengthen the support ribs and provide a continuous plastic surface on the bottom of the substrate section for resting on the sub-floor of a building. Briefly described, the substrate section 26 in FIG. 2 has a forward edge portion 27, a rear edge portion 28, a first end portion 29, and a second end portion 31. An upwardly open channel 32 is formed along and adjacent the rear edge portion of the substrate section for receiving a threshold cap and is bounded along its rear edge by an upstanding nosing 30, which also is integrally molded with the substrate section 26. An array of support ribs 33 extend from the forward edge of the upwardly open channel to the forward edge portion of the substrate section for supporting an extruded aluminum sill attached to the substrate. Plastic webs 34 span the spaces between the support ribs 33 on the bottom of the substrate section. While the webs require that more plastic be used in the molding of the substrate section than with the open or block version of FIG. 1, they nevertheless strengthen the support ribs and provide a continuous flat surface along the bottom of the substrate section for resting on the sub-floor of a building.

As with the embodiment of FIG. 1, the substrate section 26 of FIG. 2 is formed with a pair of dovetail tongues 36 and 37 projecting from one end portion 29 thereof and a corresponding pair of dovetail grooves 38 and 39 formed in the opposite end portion 31. In this way, as discussed above, two substrate sections can be securely locked together end-to-end to form a longer continuously extending substrate by bringing their ends together and twisting one relative to the other so that the dovetail tongues of one lock into the dovetail grooves of the other.

Figure 3:
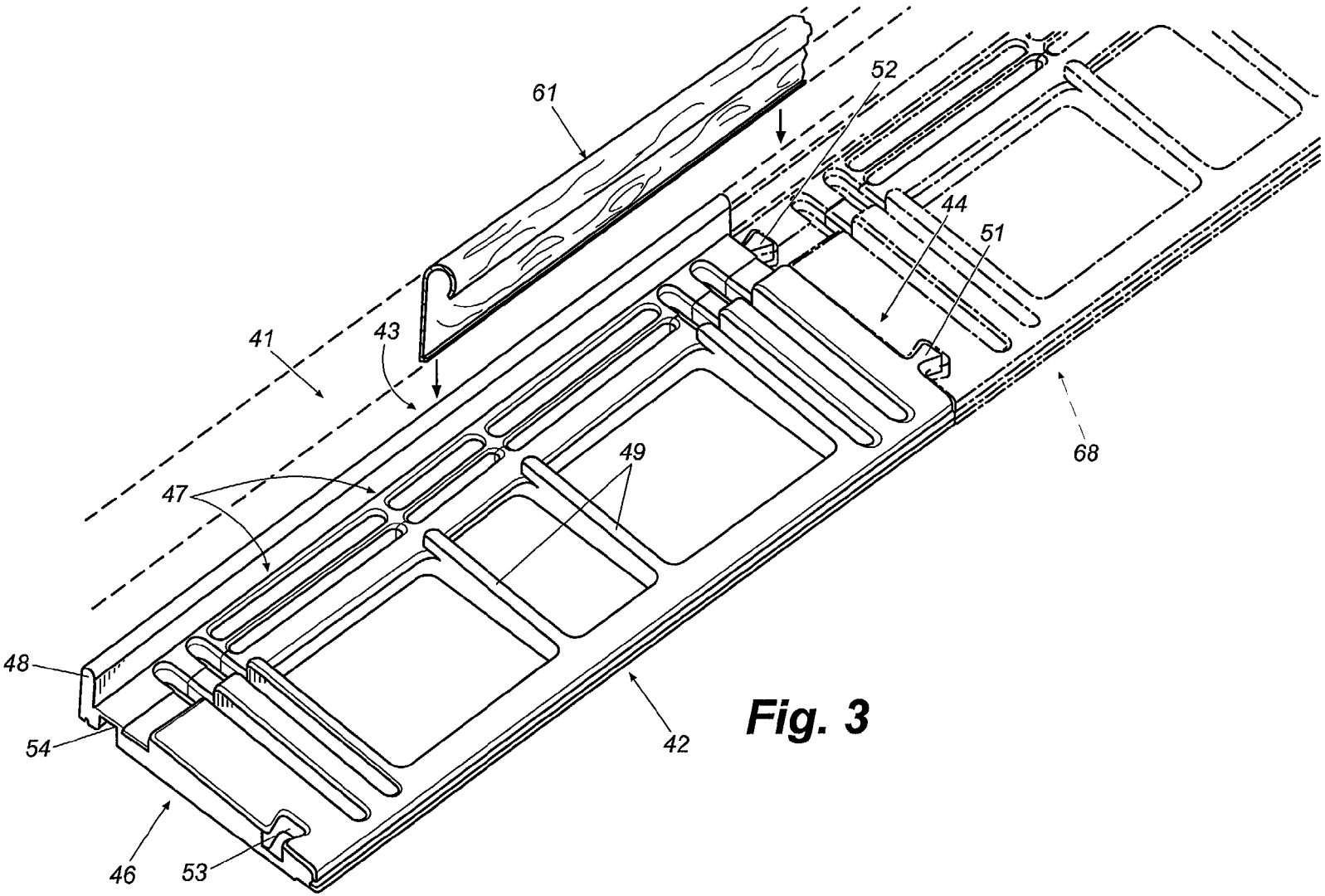
FIG. 3 is a perspective view showing two substrate sections joined together end-to-end to form a support substrate according to the invention.

FIG. 3 illustrates a shorter molded substrate section that forms a part of the modular substrate system of the present invention. The substrate section 41 is similar in most respects to the longer section 11 of FIG. 1, but is shorter and, in fact, preferably has a length corresponding to the width of a standard sidelight panel of an entryway. The longer section 11 of FIG. 1 preferably has a length corresponding to the width of a standard door of an entryway, all for purposes described in more detail below. The substrate section 41 preferably is molded of plastic, a plastic with a filler, a wood composite, or a plastic composite material and has a forward edge portion 42, a rear edge portion 41, and ends 44 and 46. An upwardly open channel 47 is formed along and adjacent the rear edge portion for supporting a threshold cap. Support ribs 49 extend from the channel 47 to the forward edge portion 42 of the substrate section for underlying and supporting an extruded aluminum sill mounted on the substrate section. Dovetail tongues 51 and 52 are formed on the end portion 44 and dovetail slots 53 and 54 are formed on the other end portion 46.

In FIG. 3, the substrate section 41 is shown attached to the end of another substrate section 68, shown in phantom lines, thereby extending the total length of the resulting substrate. When two substrate sections are attached end-to-end in this manner, it will be seen that a gap or crack may be visible along the junction of the aligned upstanding nosings of the two sections where they join together. Such a gap or crack may be considered unsightly and undesirable because the nosing generally is visible from the inside of a building in which an entryway is installed. To cover the gap or gaps along the nosing and to provide a more acceptable appearance, a traditional extruded plastic nosing strip 61 may be provided. The nosing strip 61 is configured to snap onto the upstanding nosings of the joined substrate sections and may be formed with a wood grain or other decorative surface. The nosing strip is sized to extend along the entire length of the joined-together sections of substrate to provide a continuous aesthetically pleasing appearance from inside a building.

FIG. 4 also shows the plastic substrate section of FIG. 3, but from a different perspective. In this figure, the placement of the dovetail tongues, with the forward tongue adjacent the top surface of the end section 41 and the rear tongue adjacent the bottom surface, is clearly visible. Similar placement of the dovetail slots 53 and 54 in the other end (FIG. 3) allows for the "twist and lock" fastening and locking together of substrate sections as discussed above.

Using the modular interlocking substrate sections described and shown in FIGS. 1-4, a system for fabricating threshold assemblies to accommodate virtually any entryway width and configuration can be provided using only two or three standard lengths of interlocking substrate sections. The sections may be interlocked in various ways to form substrates having a wide variety of lengths to accommodate an equally wide variety of entryway widths and corresponding threshold assembly lengths. For example, a modular substrate system might comprise a longer molded plastic substrate section having a length corresponding to the width of a standard door and a shorter substrate section having a length corresponding the width of a standard sidelight panel. Such a system can be used to fabricate thresholds to accommodate at least 6 different common entryway configurations. More specifically, for a simple single door entryway, the longer substrate section is selected whereupon an extruded aluminum sill is attached and a threshold cap is installed in the upwardly open channel. The dovetail tongues are then simply trimmed from one end and the resulting threshold is attached between the bottoms of a pair of door jambs in the usual way to form the completed pre-hung entryway assembly.

For an entryway having a single door and a single sidelight on one side, a shorter substrate section is attached to a longer substrate section to form the substrate. An extruded aluminum sill of appropriate length is snapped over the joined substrate sections and a threshold cap and sidelight panel cap are snapped into the upwardly open channel to underlie the door and sidelight panel respectively. The resulting threshold then has a length appropriate to extend beneath the door and the sidelight and may be attached between the bottoms of the jambs in the usual way with the mull post resting on the top surface of the threshold assembly. In this or any of the configurations, a nosing cap may be snapped onto the inside nosing of the substrate to cover the junction between the joined substrate sections and to provide a pleasing appearance.

For an entryway having a single door with two sidelights flanking the door, a pair of shorter substrate sections are attached to opposite ends of one longer substrate section and the resulting substrate is supplied with an aluminum sill, a threshold cap, and sidelight panel caps. The threshold is thus correctly sized to span the bottom jambs of the double sidelight entryway and a decorative nosing strip may be used to cover the gaps between substrate sections. In a similar fashion, for a double or patio door entryway, two longer substrate sections are joined together and supplied with a sill, threshold cap, and nosing strip to complete the finished threshold assembly. For a three panel patio door entryway, three longer substrate sections may be attached as described. A double door with single sidelight may be accommodated with two longer sections and a single shorter section while a double door with double sidelight panels may require two longer sections and two shorter sections.

Thus, with the modular interlocking substrate system of the present invention, thresholds for a wide variety of popular entryway configurations and sizes may be fabricated with a simple system of just two interlocking substrate sections. Adding a third length section to accommodate, for instance, a different width door expands the system even more. Accordingly, all of the advantages of an injection molded plastic substrate for a threshold assembly may be realized without the need to fabricate and stock dozens of different length substrates. The threshold assembler or the pre-hanger, as the case may be, need simply stock two or three standard substrate sections and mix and match them as needed to form completed substrates having a wide variety of different lengths.

Furthermore, since the substrates for the most part are covered and not visible to a user, they may be molded from a variety of plastics and fillers, and perhaps most significantly from recycled materials. For instance, prototype substrates sections have been molded from recycled milk jugs mixed with rice hulls or wood flower as a filler. Generally, any type of recyclable plastic material and any appropriate filler may be used to form the substrate sections, so long as it is dimensionally and thermally stable. Further, as is illustrated in the attached drawings, the end portions of the substrate sections that form the modular system of this invention are wider and thicker than the support ribs of the sections. This provides two advantages. First, they accommodate screws, staples, and other fasteners that may be used to attach the bottom ends of door jambs to the ends of the threshold assemblies. Second, with sections sized to correspond to standard door and sidelight panel widths, the portions of the substrates where sections are joined together are thicker and wider and contain more plastic for secure attachment and support of the bottoms of mull posts that traditionally separate the door opening from the sidelight openings. In general, wider thicker sections can be located anywhere along the lengths of the substrate sections in lieu of support ribs to provide a more solid substrate for supporting mull posts and the like.

FIG. 5 illustrates another embodiment of the substrate sections of this invention and also illustrates the method of the invention for fabricating threshold assemblies. Although FIG. 5 is an exploded perspective, it will be understood that when the components are assembled as shown and described below, a complete threshold assembly that may be attached between the bottom ends of the jambs of an entryway is formed. The threshold assembly 61 includes a molded plastic, plastic composite, or plastic and filler substrate 59. The substrate 59 is formed by two or more substrate sections 62 and 63 joined end-to-end to define a substrate 59 of appropriate length. The substrate sections 62 and 63 are similar in many respects to the substrate sections illustrated in FIGS. 1-4. However, in this embodiment, the substrate sections are joined together not by the dovetail tongues and slots of the previously illustrated embodiments, but rather by a sliding dovetail joint. More specifically, the substrate section 62 is formed on one end with a elongated dovetail 68 that extends along the end of the substrate section approximately from its forward edge to its rear edge. The mating end of substrate section 63 is formed with a corresponding elongated dovetail slot 69, which also extends along the end of the substrate section from its forward to its rear edges. The dovetail 68 and slot 69 are sized and configured such that the two threshold sections may be joined together at their ends by sliding the dovetail 68 into the dovetail slot 69, as illustrated by arrows 71. It has been found that such a sliding dovetail joint is stronger and more robust than the joints of FIGS. 1-4 for many applications and thus may be preferred. Of course, any appropriate method of attaching the substrate sections end-to-end may be used and all are within the scope of the invention.

When the substrate sections 62 and 63 are joined together, they form a substrate having a length corresponding to the sum of the lengths of the joined sections. An extruded aluminum sill 64, cut to the length of the substrate, is then snapped into place on the joined substrate sections. The sill 64 is formed with an outside edge 72 and an inside edge portion 73 spanned by a sill deck 80. The outside edge portion 72 of the sill is configured to wrap around and capture the forward edges of the joined substrate sections. The inside edge portion 73 of the sill is formed with a depending tongue 74 having an in-turned tang 76. An upstanding wall or dam 77 projects upwardly from the inside edge portion of the sill. The sill is snapped into place on the substrate by fitting its outside edge over the forward edge of the substrate and urging the inside edge of the sill downwardly onto the substrate until the in-turned tang 76 snaps into corresponding grooves (not visible) formed along the back edges of the ribs of the substrate sections. In this way, the sill is securely attached to the substrate and reinforces the joints between substrate sections, thereby forming a strong rigid structure. Further, the upstanding dam 77 of the sill along with the aligned rear nosings 65 of the substrate sections form an upwardly open channel extending along the inside edge portion of the threshold assembly.

With the sill in place on the substrate, a nosing strip 67, which preferably is extruded of plastic with a wood grain or other appropriate appearance, is snapped into place covering the aligned nosings 65 of the substrate sections. The nosing strip, which is visible from the inside of a structure, covers the somewhat less attractive nosing of the substrate and hides the junctions between adjacent substrate sections. A threshold cap 66 is located in the upwardly open channel and positioned to underlie a closed door mounted in an entryway incorporating the threshold of this invention. In the illustrated embodiment, the threshold cap 66 has a downturned lip 81 that fits over the dam 77 of the sill to prevent leakage of water into the upwardly open channel. Further the threshold cap is vertically adjustable by means of adjustment screws 82 and preferably is of the typed that may be positioned at any desired location along the length of the threshold. When fabricating threshold assemblies for use with sidelight entryways, it will be understood that sidelight caps as needed also are located in the upwardly open channel to under sidelight panels of the entryway. As with the threshold caps, the sidelight caps also may be selectively positioned along the length of the upwardly open channel to accommodate a wide variety of sidelight entryway designs.

The invention has been described herein in terms of preferred embodiments that represent the best mode known to the inventors of carrying out the invention. It will be obvious to those of skill in the art, however, that various additions, deletions, and modifications may well be made to the illustrated embodiments without departing from the spirit and scope of the invention. For instance, while snapping or sliding dovetail tongues and slots have been illustrated as the preferred method of attaching substrate sections together in end-to-end relationship, many other mechanisms for attaching the sections are possible and all are considered to be equivalents to the illustrated embodiments. For example, splines or splints or dowels may be used to avoid the necessity of molding the substrate sections with male and female ends. The sections may even be screwed together with screws if desired, even though the extra manufacturing steps required are thought to be undesirable. As mentioned above, a wide variety of materials may be used to mold the substrate sections including plastics, recycled plastics, plastic composites, resin and filler composites, plastics with fillers such as wood flour, and the like. Any such material that is stable and resistant to deterioration and rotting may be appropriate for forming the substrate sections. Finally, the specific structure of the substrate, sill, threshold cap, and other components of the illustrated embodiments are preferred, but are not necessary of limiting to the invention. The invention may be adapted to virtually any threshold design including, for instance, handicap thresholds, which generally do not include threshold caps. These and other additions, deletions, and modifications may well be envisioned and made by those of skill in the art without departing from the spirit and scope of the invention, as set forth in the claims.

What is claimed is:

1. A threshold assembly comprising:

a substrate made of at least two substrate sections attached and interlocked together end-to-end, the substrate having an inside edge and an outside edge, the substrate sections being shaped to define an upstanding rear nosing that extends along the inside edge of said substrate and being formed of recycled plastic and a filler selected from the group consistent of rice hull and wood flour;

a sill mounted on a portion of said substrate, said sill including an upstanding dam disposed between said inside edge and said outside edge of said substrate and in facing relationship to said upstanding rear nosing, said rear nosing and said upstanding dam forming walls of an upwardly open channel; and a threshold cap mounted in said upwardly open channel.

2. A threshold assembly as claimed in claim 1 and wherein said substrate sections are attached together with dovetail tongues on an end of one substrate section received and interlocked within corresponding dovetail grooves in an adjacent end of another substrate section.

3. A threshold assembly for an entryway, said threshold assembly comprising:

an elongated substrate having inside and outside edges and being formed from at least two substrate sections joined together in end-to-end relationship;

the substrate sections being formed of recycled plastic and a filler selected from the group consistent of rice hull and wood flour;

a sill mounted to and at least partially covering said substrate, said sill defining a sill deck supported by said substrate and an upstanding dam disposed between said inside and outside edges of said substrate; and wherein a nosing portion of said substrate extends along said inside edge of said substrate, the nosing portion of said substrate and the dam portion of said sill forming walls of an upwardly open channel extending along said threshold assembly and further comprising a threshold cap positioned within said upwardly open channel to underlie a closed door of an entryway in which said threshold is installed.

4. A threshold assembly as claimed in claim 3 and further comprising a panel cap positioned in said upwardly open channel to underlie a sidelight panel of an entryway in which said threshold assembly is installed.

5. A threshold assembly comprising:

at least a first and second substrate section;

the first substrate section having at least one protruding element along at least one end of the first substrate section;

the second substrate section having at least one slot along at least one end of the second substrate;

the protruding element of the first substrate section being slidingly engaged in end-to-end relationship with the slot of the second substrate section wherein the two substrate sections are in substantially the same plane during engagement;

the at least first and second substrate sections, are disposed at least partially beneath a sill and being capable of being affixed between bottom ends of a plurality of jambs to form a doorway; an upwardly open channel formed at least in part by one of the sill and substrate sections; and the assembly forming a threshold and capable of being positioned between the plurality of jambs.

6. The threshold assembly of claim 5 further comprising:

an inside edge and an outside edge on the substrate sections, the substrate sections being shaped to define an upstanding rear nosing that extends along the inside edge of said substrates;

the sill including an upstanding dam disposed between said inside edge and said outside edge of said substrate and in facing relationship to said upstanding rear nosing, and said rear nosing and said upstanding dam forming walls of said upwardly open channel; and a threshold cap mounted in said upwardly open channel.

7. A threshold assembly of claim 6 further comprising a panel cap positioned in said upwardly open channel to underlie a sidelight panel of an entryway in which said threshold assembly is installed.

8. A threshold assembly of claim 5 wherein said substrate sections are made of plastic.

9. A threshold assembly of claim 5 wherein said substrate sections are made of plastic and a filler.

10. A threshold assembly of claim 5 wherein said sill is formed of extruded aluminum and wherein said substrate sections are molded from deterioration resistant material.

* * * * *